US009060661B2

(12) United States Patent
Mantyla et al.

(10) Patent No.: US 9,060,661 B2
(45) Date of Patent: Jun. 23, 2015

(54) FEMALE ELECTRICAL RECEPTACLE FOR MOUNTING BEHIND AN INLET VALVE OF A CENTRAL VACUUM CLEANING SYSTEM

(71) Applicant: Canplas Industries Ltd., Barrie (CA)

(72) Inventors: James Mantyla, Barrie (CA); Scott Baldwin, Innisfil (CA)

(73) Assignee: CANPLAS INDUSTRIES, LTD., Barrie, Ontario (CA)

( * ) Notice: Subject to any disclaimer, the term of this patent is extended or adjusted under 35 U.S.C. 154(b) by 112 days.

(21) Appl. No.: 14/075,579

(22) Filed: Nov. 8, 2013

(65) Prior Publication Data

US 2014/0130892 A1 May 15, 2014

(30) Foreign Application Priority Data

Nov. 9, 2012 (CA) ..... 2794991

(51) Int. Cl.
*H01R 4/60* (2006.01)
*A47L 9/24* (2006.01)
*A47L 5/38* (2006.01)

(52) U.S. Cl.
CPC ..... *A47L 9/246* (2013.01); *Y10T 137/9029* (2015.04); *Y10T 137/0491* (2015.04); *A47L 5/38* (2013.01)

(58) Field of Classification Search
CPC .... H01R 13/005; H01R 13/74; H01R 13/741; H01R 13/743; H02G 3/08; H02G 3/086
USPC ..... 439/190, 191, 192, 389, 417; 200/61.6; 174/53, 66
See application file for complete search history.

(56) References Cited

U.S. PATENT DOCUMENTS

| | | | | |
|---|---|---|---|---|
| 4,758,170 | A | 7/1988 | Hayden | |
| 4,790,771 | A | 12/1988 | Kleiner | |
| 5,004,428 | A | 4/1991 | Hayden | |
| 5,127,153 | A | 7/1992 | Mitra | |
| 5,190,469 | A | 3/1993 | Mui | |
| 5,448,827 | A | 9/1995 | Ward | |
| 5,578,795 | A | 11/1996 | Ward | |
| 5,785,551 | A | 7/1998 | Libby | |
| 5,886,299 | A | 3/1999 | Ward | |
| 6,682,363 | B1 | 1/2004 | Chang | |
| 7,144,269 | B2 * | 12/2006 | Libby et al. | 439/409 |
| 7,281,941 | B1 * | 10/2007 | Libby et al. | 439/409 |
| 7,637,760 | B2 | 12/2009 | Sheremeta et al. | |
| 2011/0100485 | A1 | 5/2011 | Mantyla et al. | |

* cited by examiner

*Primary Examiner* — Vanessa Girardi
(74) *Attorney, Agent, or Firm* — Hoffmann & Baron, LLP

(57) ABSTRACT

A female electrical receptacle for mounting behind an inlet valve of a central vacuum cleaning system, having a base portion and a cover portion wherein the base portion defines three open topped channels and two side channels include an electrically conductive bayonet extending into said channel. The central channel retains the ground wire. Each bayonet is electrically connected to a female pin receptacle located toward one end of said base portion. The cover is sized and shaped to be field securable to said base portion to close said open top channels onto said bayonets, The female electrical receptacle further includes attachment features adjacent the pin receptacles, which are sized and shaped to engage with said inlet valve to permit said one end to be mounted behind said inlet valve and connected to a plug opening in said inlet valve. An electrical wire may be field inserted between the cover and the base so that when the cover is secured to the base an electrical connection is completed by the bayonets between the wire and the pin receptacles to electrify the plug opening in the inlet valve.

19 Claims, 6 Drawing Sheets

FEMALE ELECTRICAL RECEPTACLE FOR MOUNTING BEHIND AN INLET VALVE OF A CENTRAL VACUUM CLEANING SYSTEM

CROSS-REFERENCE TO RELATED APPLICATIONS

The instant application claims the priority under 35 U.S.C. §119 (a)-(d) of prior Canadian Intellectual Property Office patent application No. 2,794,991, filed 9 Nov. 2012, having the same title, applicant and inventive entity as the present application, and currently pending. The complete disclosure of this priority application is hereby incorporated by reference for all purposes.

BACKGROUND

1. Field of the Disclosure

This invention relates generally to the field of central vacuum systems and more particularly to inlet valves on central vacuum systems, of the type which receives a hose cuff of a central vacuum hose to connect the vacuum hose to a source of suction. Most particularly this invention relates to those types of inlet valves that include a current carrying electrical receptacle to connect a powered accessory (e.g., beater bar motor), carried for example at the end of a vacuum wand at a far end of the hose to a source of electrical power through said inlet valve.

2. Brief Discussion of Related Art

Current carrying inlet valves are known in central vacuum cleaner systems. Often they include a backing or mounting element, sometimes referred to as a mounting plate, secured to a stud or the like within a wall and an inlet valve, which is in turn secured to the mounting element. The inlet valve and the mounting element combine to form an inlet into vacuum piping running through the walls. The inlet valve usually is provided with a hinged cover which closes and seals a central vacuum opening when the valve is not in use. The opening in turn is connected to central vacuum piping network through which the suction is provided.

Typically low voltage electrical contacts are provided within the central vacuum opening and a conductive sleeve or a split ring configuration is provided on an insertion hose cuff of an associated central vacuum hose so that when the hose cuff is inserted into the opening a circuit is completed energizing a remote central vacuum motor to create the desired suction in the piping network. In this way, airflow is passed through the hose from a free end, for example through an attached accessory where it can be used to draw dirt, debris and the like into the hose, then through the valve and into and through the piping network until it is deposited in a debris collecting receptacle. The receptacle is associated with the vacuum source and is detachable to permit it to be periodically emptied.

A current carrying inlet valve assembly is one which also includes a high voltage (usually household current) electrical connection in the inlet valve assembly to complete a circuit to power an accessory such as a beater bar or the like at the free end of the hose or wand. In one form of prior current carrying inlet valve assembly as taught in U.S. Pat. No. 4,758,170 (Hayden), the inlet includes a female receptacle permanently mounted to the back of the valve, but accessible from the front of the valve through an opening in the valve so that a male pronged plug formed as part of the insertion hose cuff on the central vacuum hose can electrically mate with the female receptacle when the hose cuff is connected to the source of suction through the inlet valve assembly. In other words the electrical and vacuum connections are made at the same time through adjacent connections.

However, this prior design requires connecting the standard household wiring to the back of the female plug receptacle, behind the inlet valve assembly. Such a connection is an open electrical connection creating the need, according to standard building codes, for an electrical box located behind the inlet valve within which to enclose the electrical connection made between the open or bare wires. This type of connection requires the usual wire nuts and twisted wire combination of a conventional electrical wiring connection. The ground wire in a conventional electrical installation is either connected to the metal box or to the plug or receptacle directly. Because of the space limitations imposed by the presence of the central vacuum piping, and the receptacle position required to mate with the hose cuff, there is little room for the code required electrical box. As a result the prior art teaches using a box which is molded in a curved shape to fit over the vacuum piping or fitting. This makes it awkward for an electrician to complete the wiring connection within the small sized awkwardly shaped box. Further the need for a separate specially molded electrical box adds to the number of parts required in the central vacuum valve assembly and so adds to the expense of the overall valve system and the installation thereof.

In an attempt to address these problems a further design was developed as taught in U.S. Pat. Nos. 5,886,299, 5,578,795 and 5,448,827 in which a pig tail lead (molded plug with wires) was fabricated which was made field mountable into the inlet valve during installation. Mounting means are provided on the front of the flexible plastic plug to allow it to be deformed and rotated into place behind the inlet valve, where it is accessible to a male plug built into a hose cuff of a central vacuum hose. The electrical wire is factory molded into the plug, eliminating any open or bare wire electrical connection at the rear of the plug and eliminating therefore the need for an electrical box directly behind the inlet valve assembly. All that is required to complete an installation is to feed the pig tail wire back to an existing nearby electrical box to complete the bare wire electrical connections in the box in conformance to electrical code requirements. Although this works well for installations where the existing electrical box is close to where the central vacuum inlet valve is installed, it requires a preset amount of electrical wire to be provided as the pig tail lead for every molded plug. If this wire is too long, then it is cut off and wasted. If it is too short, it won't reach and thus will require the installer to mount a further electrical box within reach, thereby increasing the installation time and cost. Therefore while solving some of the problems of the previous invention, by simplifying the valve assembly and installation procedures, it creates some other additional issues which need to be addressed.

Other examples of prior art devices include: U.S. Pat. No. 4,790,771; U.S. Pat. No. 5,004,428; U.S. Pat. No. 5,127,153; U.S. Pat. No. 5,190,469; U.S. Pat. No. 5,785,551; U.S. Pat. No. 6,682,363; U.S. Pat. No. 7,637,760; and United States Patent Application Publication No. US2011/0100485 A1.

What is desired, is an improved design that overcomes the disadvantages of the prior art.

SUMMARY

The present invention is directed to a simple and easy to use assembly for making an electrical connection to a female receptacle that forms part of the inlet valve assembly without the need for an electrical box, namely without making an open electrical connection at the rear of the inlet valve assembly. The present invention also provides a simple field makeable connection for a standard household wire, such as a 14 to 12 gauge ROMEX-type house wire directly to the female receptacle without the need for a factory installed pigtail lead of a predetermined length. The present invention therefore allows the installer to complete a conventional bare electrical connection within the nearest existing standard electrical box, to feed the wire over to the central vacuum inlet valve, no matter where the same is located, and then to cut the wire to the exact length needed to position the female electrical receptacle on the back of the valve. According to the present invention this can be done without causing any waste or without being too short and thus requiring an extra open bare wire connection which in turn requires an additional electrical box, which in most cases code will require this box to be accessible, thus adding a redundant blank cover plate on the finished wall to be installed.

The present invention further accommodates the electrical connection being formed before or after the female receptacle is mounted to the inlet valve assembly thus giving the installer a great deal of flexibility for the installation. In the latter case though, care must be taken to avoid cutting the connecting wire too short to permit the female receptacle to reach the inlet valve. This flexibility is accomplished in the present invention by means of an electrical connection that is closed and thus does not require a separate electrical box at the inlet valve and which is also field made and so does not require a factory made pig tail wire. The electrical connection is made in a female electrical receptacle that is provided most preferably with a hinged clear cover that can be snap fit into position onto a convention electrical wire carried in a base portion. Once the outer sheath is removed from the wire, the two current carrying insulated leads can be fed into channels in the base portion with the ground wire located between the channels in a slot. When the cover is snapped in place electrically conductive bayonets are forced through the insulation to electrically connect the wires with two pin receptacles located at one end of the female plug. The ground wire is also secured in place in the base under the hinged cover and strain relief features are provided at the other end of the wire to secure the wire between the cover and the base. In this way the present invention provides for an electrical standard approved, field made electrical connection that does not require an electrical box, as it is not an open connection and allows for a field mounting of the electrical receptacle to the inlet valve to permit ease of installation.

Therefore according to a preferred aspect the invention provides a female electrical receptacle for mounting behind an inlet valve of a central vacuum cleaning system, the female electrical receptacle comprising:

a base portion and a cover portion wherein the base portion defines an open end, a pair of open topped wire receiving channels extending from said open end, an electrically conductive bayonet extending into each of said channels, and a female pin receptacle electrically connected to each one of said bayonets, said pin receptacles being remote from said open end of said base portion, said base portion further including a ground wire receiving feature extending from said open end, said cover being sized and shaped to be field secured to said base portion to cause wires placed in said wire receiving channels to be forced onto said bayonets to complete an electrical connection between said wire and said pin receptacles, and to close said open tops of said wire receiving channels, said female electrical receptacle further including attachment features sized and shaped to engage with said inlet valve to permit said receptacle to be mounted in a plug opening in said inlet valve, wherein an electrical wire may be field inserted between said cover and said base so that when said cover is secured to said base an electrical connection is made between said wire and said pin receptacles and said receptacle may be field attached to said inlet valve to provide an electrified plug opening in said inlet valve.

According to another aspect of the present invention there is provided an inlet valve assembly for a central vacuum system, said inlet valve assembly comprising:

an inlet valve including a hinged cover with a gasket for sealing a vacuum opening, a mounting element attached to said inlet valve to secure said inlet valve to an associated wall support structure, and an electrical plug snap fit to one side of said inlet valve and having a wire extending out of one end of the plug and female sockets at the other end and having a transparent cover to permit the visual verification of an electrical connection within the electrical plug of the wire to the female sockets, wherein the female sockets of the electrical plug are accessible from another side of said inlet valve through an opening in the inlet valve.

According to a further aspect the present invention provides a method of installing an inlet valve assembly on a central vacuum system, said method comprising the steps of:

leading a wire to where the inlet valve assembly is to be installed;

removing an outer sheath of said wire;

feeding the exposed wire elements into a base;

securing a transparent cover onto the base and to secure said wire elements in place and to complete an electrical connection within said base to form an electrical plug having female sockets at one end;

inspecting said plug through said transparent cover to evaluate the position of said wire elements; and securing said plug to said inlet valve to expose said female sockets though an opening in said inlet valve.

These and other purposes, goals and advantages of the present disclosure will become apparent from the following detailed description of example embodiments read in connection with the accompanying drawings.

BRIEF DESCRIPTION OF THE DRAWINGS

Reference will now be made, by way of example only, to preferred embodiments of the invention with reference to the following drawings in which.

DETAILED DESCRIPTION

Figure 1:
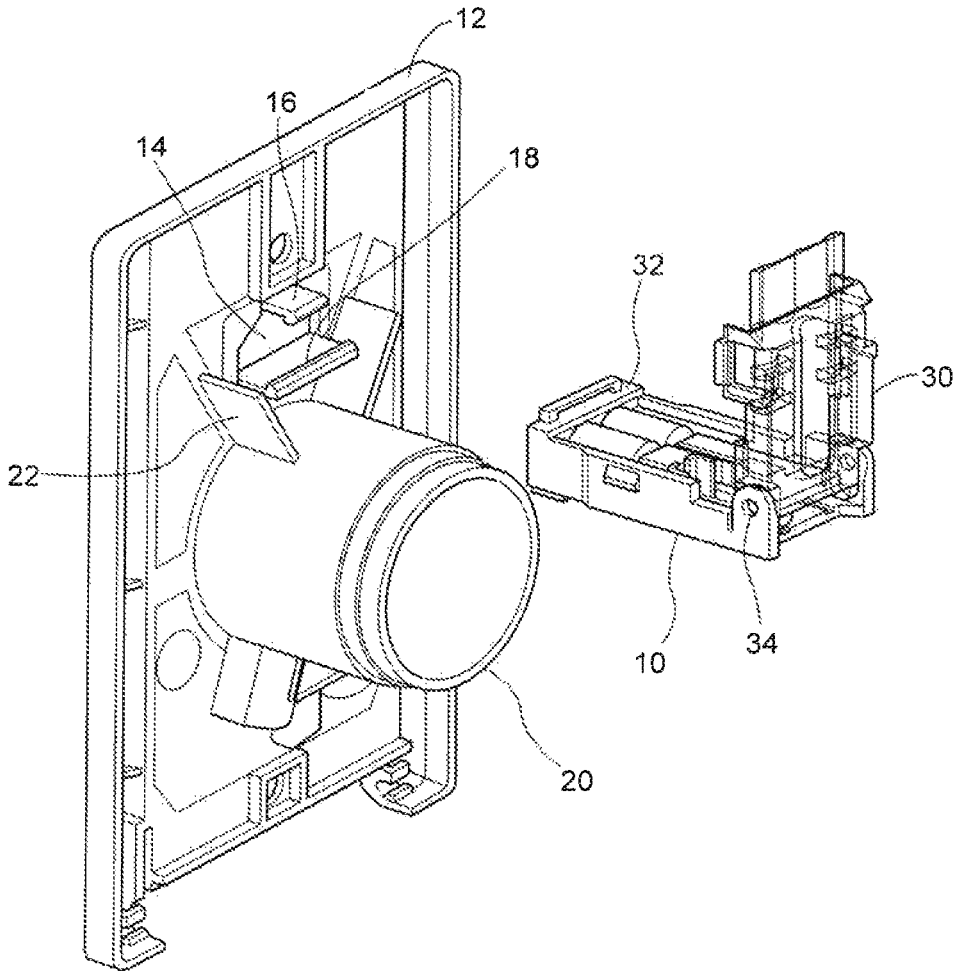
FIG. 1 is a perspective view from the side of a preferred embodiment of a female receptacle according to the present invention in an open position and spaced apart from an associated inlet valve.

FIG. 1 shows a female electrical receptacle 10 spaced apart from an associated inlet valve 12 for a central vacuum system according to the present invention. The inlet valve includes a plug shaped opening 14 with an upper attachment tab 16 and a lower attachment tab 18. The attachment tabs 16 and 18 are for securing the receptacle 10 in position to the back of the inlet valve 12 as described in more detail below.

Apart from the opening 14 and the tabs 16 and 18 the inlet valve 12 is conventional and its other features will be known to those skilled in the art. For example the inlet valve includes a spigot 20 with support ribs 22. The spigot 20 fits into a female vacuum opening formed in a mounting plate (not shown) which mates with the inlet valve to complete a vacuum connection to a network of central vacuum piping. Further the inlet valve is typically provided with a hinged cover (not shown) which is mounted on an opposite side of the inlet valve to the receptacle 10. It will be understood by those skilled in the art that the exact form of the inlet valve is not germane to the present invention except for the attachment features which are described below and thus the present invention can be used with many different styles and types of inlet valve assemblies. Thus while one form of inlet valve assembly is illustrated in the drawings, it is by way of example only and is not limiting of the assemblies the present invention may be applied to.

The receptacle 10 is shown with an open top 30 on a base 32. A hinge 34 is shown to attach the top 30 to the base 32. Most preferable the top 30 is formed from a clear plastic, which is fire rated to suit household current carrying connection. While a clear or transparent plastic is preferred the present invention comprehends that other opaque plastics can be used as well, provided that the plastic is suitably fire rated for this type of application. However, clear plastic is preferred as explained in more detail below. As well as the cover, the base 32 is preferably made from fire rated plastic to meet relevant electrical standards. In general, plastic is a preferred material for the base and the cover due to its ease of manufacture such as by molding or the like as well as the relatively low cost for the same. As the receptacle 10 surrounds an electrical connection, the plastic also is a suitable dielectric material to resist a short or the like of an attached electrical wire.

Figure 2:
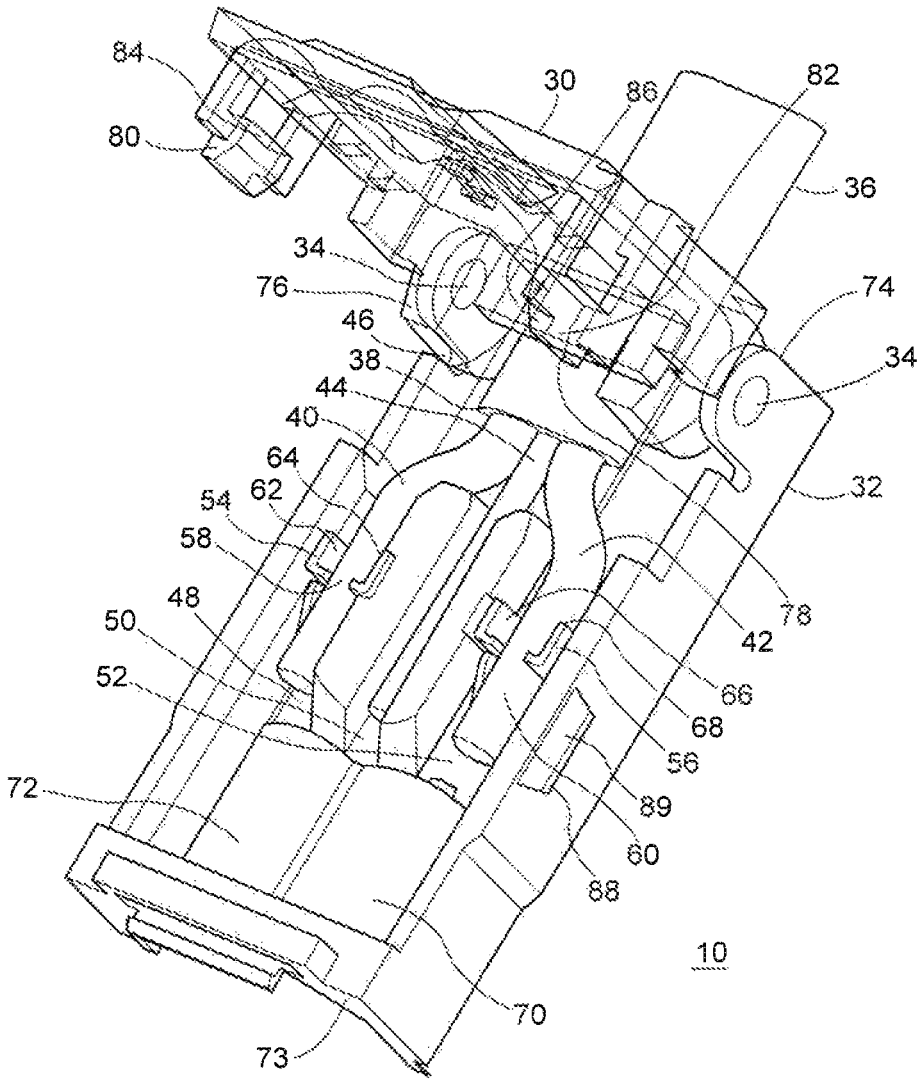
FIG. 2 is the view of FIG. 1 showing a wire with its sheathing stripped and having been inserted into the receptacle of FIG. 1 with the top open.

FIG. 2 shows the receptacle 10 of the present invention in more detail and with an associated electrical wire 36 inserted into the receptacle 10. The electrical wire 36 is a conventional ROMEX-type of wire as is commonly used for household wiring. When the outer sheath 38 is stripped off it reveals further insulated power wires 40, 42 with a ground wire 44 located in between. As shown an opening 46 is provided between the hinged cover 30 and the base 32 under the hinge 34 (shown in FIG. 1). The stripped wires can be fed into the opening 46 and the wires then placed in respective channels 48, 50 and 52 in the base 32. The channels 48 and 52, being the outside channels, are for the conductive wires 40 and 42, whereas the middle channel 50 is a ground wire receiving feature for receiving and securing the ground wire 44. Most preferable the outer channels 48 and 52 include wire engaging bayonets 54 and 56. The bayonets include an upwardly facing opening 58, 60, which defines a gap between prongs 62, 64 and 66, 68. Most preferably the inner edges of the prongs are sharpened to permit the prongs to penetrate the wire insulation and make direct contact with the wire or metal conductor underneath. It will be understood that the prongs are preferably made from a form of conductive metal which can be sharpened to enable the easy penetration of the wire insulation as needed to establish secure electrical contact. The prongs in turn are connected with conductive pin receiving structures that extend into rounded housings 70, 72. The pin receiving structures are sized and shaped to receive a male pronged plug of the type used on a vacuum hose cuff to supply power to a remote power accessory or the like. The end of the rounded housings remote from where the wire comes into the base include openings to permit the insertion of the male prong elements. Most preferably the end 73 of the base is sized and shaped to match the plug shaped opening 14 (FIG. 1) in the inlet valve face as described in more detail below.

It will be appreciated that while the base is formed from a fire resistant plastic, the prongs and pin receiving structures are conductive elements and as such are formed from conductive metal. Thus the two conductive elements are separately formed and inserted into the base. Of course to prevent short circuits the two conductive elements must be positioned within the base in a way that ensures there is no conductive path between the two elements. Without being limited by any particular assembly technique, good results have been obtained by forming undercut slots in the bottom of the channels 48, 52 and forming corresponding rails in the bayonet/pin receiving conductive metal elements whose rails are sized and shaped to fit into the undercut slots. In this way the conductive elements can be simply slid into place within the channels 48, 52 of the plastic base 32 and retained in place by the slots. As shown the ground wire 44 is a bare wire and is placed within the central channel 50. It can be cut to length and is also separate by the walls of the channel 50 from the conductive wires 40, 42.

The top cover 30 can now be better understood. In this embodiment of the invention the cover is hinged to the base to permit the components to be kept together prior to use. However, while a hinged connection works well it will be understood that the present invention comprehends other ways of attaching the cover to the base, such as a simple snap fit cover or the like. However this is thought to be less desirable as it can result in the components being separated and getting more easily lost on the job site.

As shown the hinged top cover 30 includes a number of features molded or integrally formed into it. As shown there are hinge pivots 34 which fit into housings 74, 76 on the base 32. This permits the cover 30 to be easily rotated down onto the base 32. Located between and generally below, in the closed position, the hinge pivots 70, 72, is a strain relief clamp 78. It is sized and shaped so that as the cover 30 is hinged closed it will compress the wire 36 enough to provide strain relief to the assembly. In other words, once the cover 30 is closed onto the base the clamp 78 prevents the wire 36 from accidentally being pulled out of the plug 10 exposing the conductors.

On either side of the cover 30 are formed latches 80 and 82 with locking tabs 84 and 86. Once the cover 30 has been hinged down, then the latches are designed to secure the cover in place. The tabs 84 and 86 are sized and shaped to lock onto a locking surface 88 and good results have been achieved by using the bottom edge of a tab 89 as the locking surface.

As well the underside of the cover 30 is provided with wire engaging features, designed to ensure good contact between the cover and the wires within the channels. These features may be referred to as wire pushes and they comprise raised portions on the underside of the hinged cover 30 which are sized and shaped to ensure that the wires 40, 42 and 44 are all well seated in their respective channels when the cover 32 is locked onto the base 30 and more particularly that the wires 40 and 42 are fully engaged by the bayonets and that therefore a good electrical connection has been made and secured.

Figure 3:
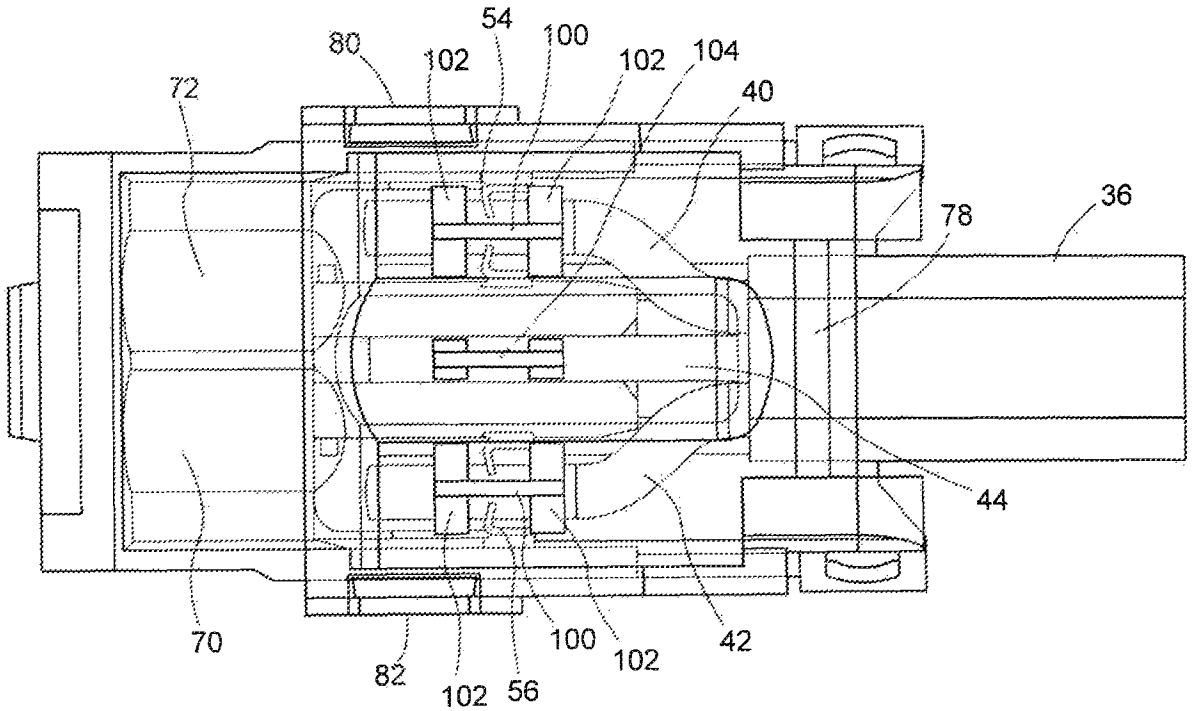
FIG. 3 is a the view of the invention of FIG. 2 from above with the top snapped shut onto the base trapping the wire between the base and the top.

FIG. 3 shows these features in top view. In particular there is a pair of central ribs 100, which extend above a middle of the channels 48, 52 and are proud of the underside of the cover 30. At either end of the ribs 100 there is provided a wire push 102 which extends away from the cover 30 a further amount from the ribs 100. Most preferably the wire pushes 102 straddle the position of the bayonets 54, 56 when the cover 30 is closed as shown. For the ground wire a similar but smaller structure is shown at 104. Most preferably the wire pushes 102 have a curved underside to better conform to the wire cross sections. It can now be understood that these wire engaging features will drive the wires down into their respective channels and in particular will drive the insulated electrical wires into full engagement with the bayonets to ensure good electrical contact there between.

FIG. 3 also shows an important aspect of the present invention and that is that by means of the use of the preferred clear plastic hinged cover 30, it is possible for the electrician or other licensed installer to visually inspect the wire connections made underneath the hinged cover 30 for the purpose of better ensuring that the wire elements, comprising for example the conductor wires and the ground wire are correctly positioned under the cover within the appropriate channels and that therefore a safe and secure electrical connection has been made. This is an advantage for a field made connection such as is contemplated by this invention as will be understood by those skilled in the art.

Figure 4:
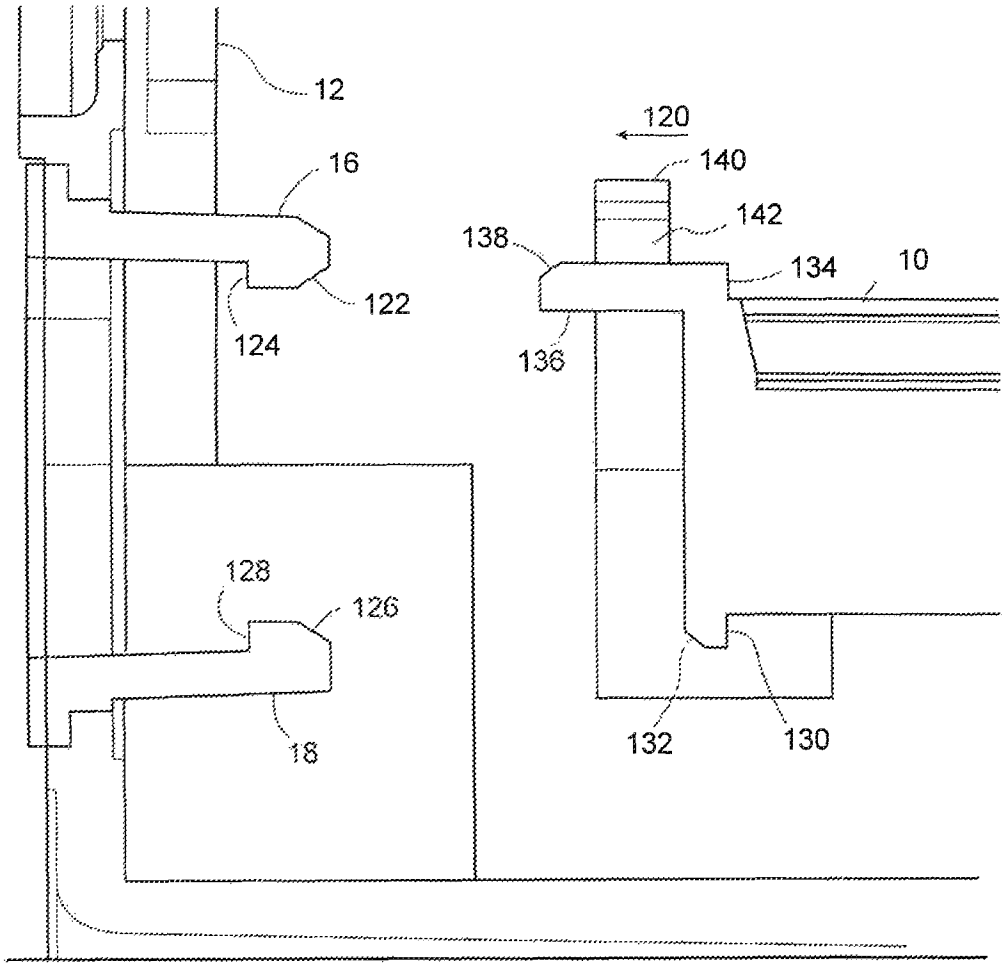
FIG. 4 is a close up view of the back of the inlet valve showing one embodiment of a connection between attachment features of the receptacle and the inlet valve assembly.

The next step of the present invention is to connect the closed plug element 10 comprising the cover 30 and the base 32 to the back of the inlet valve 12. FIG. 4 shows a side view of the plug 10 being advanced towards the back of the inlet valve 12 in the direction of the arrow 120. As can be seen the upper attachment tab 16 includes a sloped outer ramp surface 122, and a locking surface 124. Similarly the lower attachment tab 18 includes a sloped outer guide surface 126 and a locking surface 128. Opposite to these tabs 16 and 18 is the plug 10. It includes a lower locking lip 130, with a sloped outer guide surface 132 and an upper locking edge 134 behind a projection 136 having an outer guiding surface 138. Also shown is upper bridge 140 which forms an underpass 142 through which the upper locking tab 16 fits.

Figure 5:
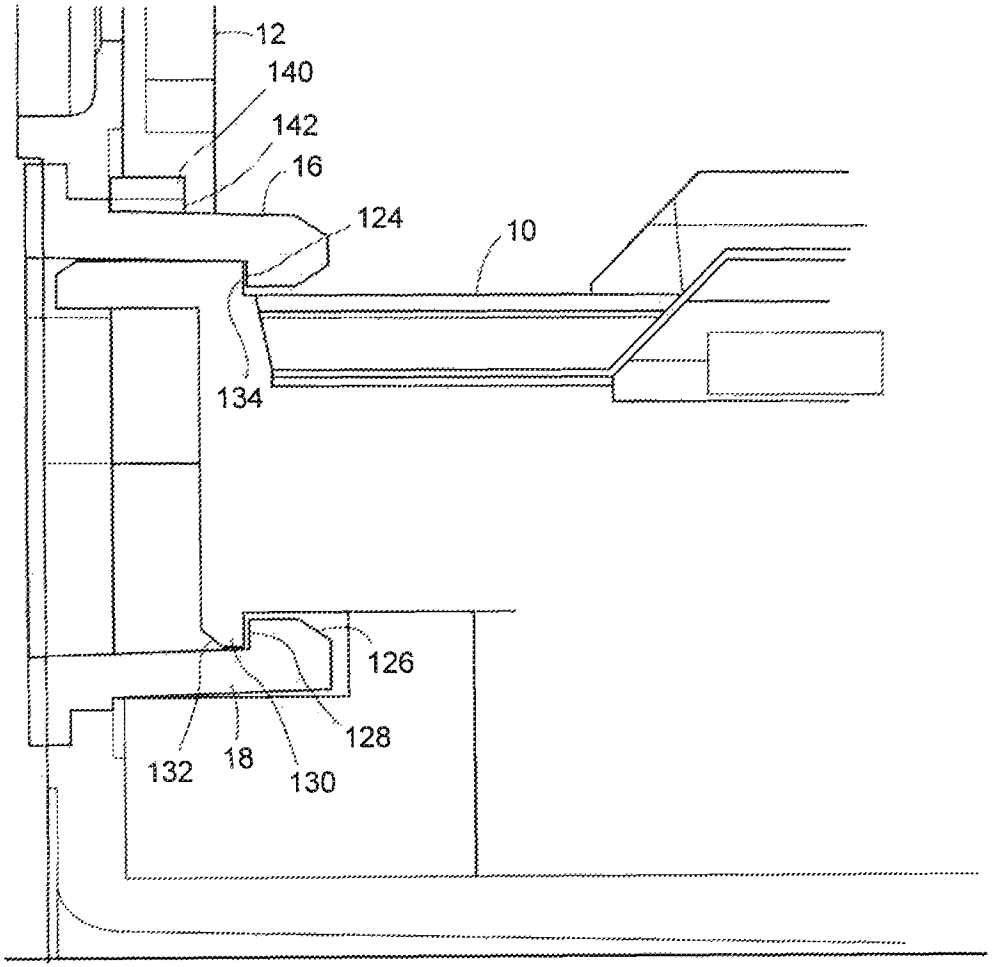
FIG. 5 is a close up view of the female receptacle of FIG. 1 before it is secured to the back of the inlet valve.

FIG. 5 shows the upper locking tab 16 inserted through the underpass 142 with the two locking surfaces 134 and 124 opposing one another. The same is true for the bottom locking surfaces 128 and 130. In this way the plug 10 is secured to the back of the inlet valve 12 and is prevented from moving towards or away from the inlet valve as male plugs are pulled out of or inserted into the pin receptacles. As can now be understood the bridge 140 helps secure the tabs in place vertically so that the stop surfaces remain in an opposed relationship and locked together.

Figure 6:
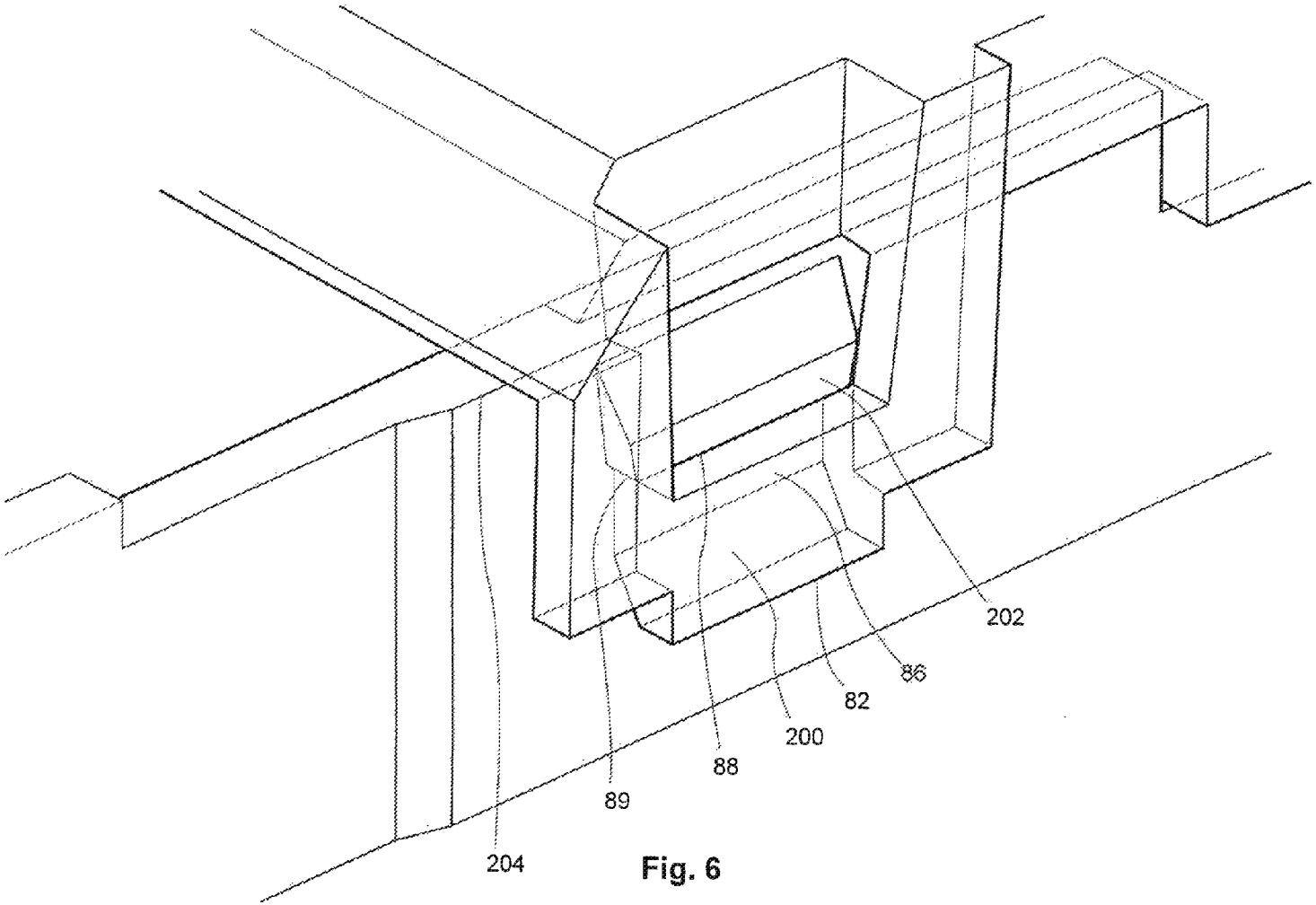
FIG. 6 is a close up view of one embodiment of a snap fit connector which can be used to keep the top closed onto the base in the preferred embodiment of FIG. 1.

FIG. 6 shows a view through the clear cover 32 of one of the top locking features 86. Although only one is discussed, it will be understood that the one on the other side shown as 80 in FIG. 2 is substantially the same. As shown, the locking surface 86 of the latch 82 is opposed by a locking surface 88 of the tab 89. When these two surfaces are in contact, then the cover 30 is closely held onto the base as shown at 204. To help permit the latch 80 to close over the tab 89, there are provided sloped guide surfaces 200 and 202 respectively. This arrangement has been found to provide good results in securing the hinged cover to the base, even though the fire resistant plastic, as is required for this application is quite stiff. It will be noted that the guide surface 200 also spaces the end of the latch 82 away from the base 32 meaning that in some cases the latch can be unlatched and the cover raised, if needed for any purpose. However, this will not be an easy maneuver to accomplish due to the stiffness of the materials as described above.

It will be appreciated by those skilled in the art that the foregoing description is with respect to preferred embodiments of the invention and that many variations and changes are possible without departing from the scope of the invention as defined by the appended claims. Some of these variations have been discussed above and others will be apparent to those skilled in the art. For example, the cover, while it is preferred to be made from a transparent material, can also be made from an opaque material, but then a visual inspection of the electrical connection made under the cover is not possible after the cover is closed.

We claim:

1. An inlet valve assembly for a central vacuum system, said inlet valve assembly comprising:

an inlet valve including a hinged cover for sealing a vacuum opening, a mounting element attached to said inlet valve to secure said inlet valve to an associated wall support structure, and an electrical plug snap fit to one side of said inlet valve and having a wire extending out of one end of the plug and female sockets at the other end and having a transparent cover to permit the visual verification of an electrical connection within the electrical plug of the wire to the female sockets, wherein the female sockets of the electrical plug are accessible from another side of said inlet valve through an opening in the inlet valve.

2. A method of installing an inlet valve assembly on a central vacuum system, said method comprising the steps of:

leading a wire to where the inlet valve assembly is to be installed;

removing an outer sheath of said wire;

feeding the exposed wire elements into a base;

securing a transparent cover onto the base and to secure said wire elements in place and to complete an electrical connection within said base to make an electrical plug having female sockets at one end;

inspecting said plug through said transparent cover to evaluate the position of said wire elements; and securing said plug to said inlet valve to expose said female sockets though an opening in said inlet valve.

3. A female electrical receptacle for mounting behind an inlet valve of a central vacuum cleaning system, the female electrical receptacle comprising:

a base portion and a cover portion wherein the base portion defines an open end, a pair of open topped wire receiving channels extending from said open end, an electrically conductive bayonet extending into each of said channels, and a female pin receptacle electrically connected to each one of said bayonets, said pin receptacles being remote from said open end of said base portion, said base portion further including a ground wire receiving feature extending from said open end, said cover being sized and shaped to be field secured to said base portion to cause wires placed in said wire receiving channels to be forced onto said bayonets to complete an electrical connection between said wire and said pin receptacles, and to close said open tops of said wire receiving channels, said female electrical receptacle further including attachment features sized and shaped to engage with said inlet valve to permit said receptacle to be mounted in a plug opening in said inlet valve, wherein an electrical wire may be field inserted between said cover and said base so that when said cover is secured to said base an electrical connection is made between said wire and said pin receptacles and said receptacle may be field attached to said inlet valve to provide an electrified plug opening in said inlet valve.

4. The female electrical receptacle of claim 3 wherein said cover portion is comprised of a transparent fire resistant plastic to permit the electrical connection to be inspected when the cover is closed.

5. The female electrical receptacle of claim 3 wherein said channels further include slots and said bayonets include tabs which slide in said slots.

6. The female electrical receptacle of claim 3 wherein said cover portion includes a strain relief flange to help secure a wire in said receptacle.

7. The female electrical receptacle of claim 3 wherein said cover portion further includes ribs on an underside of said cover portion to cause a wire clamped between said cover portion and said base portion to engage said bayonets.

8. The female electrical receptacle of claim 3 wherein said bottom portion is molded from fire and electrical resistive plastic.

9. The female electrical receptacle of claim 3 wherein said attachment features comprise pair of opposed attachment flanges which permit said female electrical receptacle to be latched to said inlet valve via snap fit details at said plug opening.

10. The female electrical receptacle of claim 3 wherein said one end is provided with a plug shaped opening.

11. The female electrical receptacle of claim 10 wherein said plug shaped opening is shaped to match the shape of a male plug built into a vacuum hose cuff.

12. The female electrical receptacle of claim 3 further including an inlet valve secured to said female electrical receptacle.

13. The female electrical receptacle of claim 12 wherein said inlet valve further includes attachment snap fit details sized and shaped to engage said attachment flanges of said female electrical receptacle to secure said female electrical receptacle to said inlet valve at said plug opening in said inlet valve.

14. The female electrical receptacle of claim 3 wherein said cover portion is hingedly connected to said base portion at said other end.

15. The female electrical receptacle of claim 14 wherein said cover portion further includes snaps to secure said cover portion to said base portion.

16. The female electrical receptacle of claim 15 wherein said strain relief flange is adjacent said hinged connection.

17. The female electrical receptacle of claim 3 wherein said ground wire receiving feature comprises a ground wire receiving channel located between said open topped wire receiving channels.

18. The female electrical receptacle of claim 17 wherein said cover includes a terminal rib positioned to prevent a ground wire from extending past said ground wire slot in said base when said cover is in a closed position.

19. The female electrical receptacle of claim 18 wherein said cover includes a securement rib to cause a ground wire to be retained in the ground wire slot when said cover is closed.

* * * * *